US012447389B1

(12) United States Patent
Dickey

(10) Patent No.: US 12,447,389 B1
(45) Date of Patent: Oct. 21, 2025

(54) GOLF PUTTING GREEN WITH CONTROLLABLE SURFACE CONTOUR

(71) Applicant: John A. Dickey, Caledonia, IL (US)

(72) Inventor: John A. Dickey, Caledonia, IL (US)

(73) Assignee: John A. Dickey, Caledonia, IL (US)

( * ) Notice: Subject to any disclaimer, the term of this patent is extended or adjusted under 35 U.S.C. 154(b) by 954 days.

(21) Appl. No.: 17/495,771

(22) Filed: Oct. 6, 2021

Related U.S. Application Data

(60) Provisional application No. 63/088,117, filed on Oct. 6, 2020.

(51) Int. Cl.
*A63B 69/36* (2006.01)

(52) U.S. Cl.
CPC ..... *A63B 69/3661* (2013.01); *A63B 2225/09* (2013.01)

(58) Field of Classification Search
CPC ..... A63B 69/3661; A63B 2225/09
See application file for complete search history.

(56) References Cited

U.S. PATENT DOCUMENTS

| | | | | |
|---|---|---|---|---|
| 1,612,291 | A | 12/1926 | Jackson | |
| 3,690,673 | A | 9/1972 | Occhipinti | |
| 3,892,412 | A | 7/1975 | Koo | |
| 4,240,637 | A | 12/1980 | Cross et al. | |
| 4,611,809 | A * | 9/1986 | Gettelfinger | A63B 67/02 473/185 |
| 4,790,538 | A | 12/1988 | Gettlefinger | |
| 5,094,569 | A * | 3/1992 | Fleming | E02D 27/32 405/36 |
| 5,441,265 | A | 8/1995 | Codlin | |
| 5,655,971 | A | 8/1997 | Wayne | |
| 5,855,522 | A | 1/1999 | Bevan | |
| 5,863,256 | A | 1/1999 | MacLean et al. | |
| 6,050,901 | A * | 4/2000 | Davis | A63B 67/02 473/160 |
| 6,056,645 | A | 5/2000 | Servatius | |
| 6,338,682 | B1 | 1/2002 | Torchia et al. | |
| 6,964,615 | B2 | 11/2005 | Lee | |
| 9,592,437 | B2 | 3/2017 | Flammer | |
| 10,166,455 | B2 | 1/2019 | Flammer | |
| 10,500,470 | B2 | 12/2019 | Flammer | |
| 2017/0348581 | A1 | 12/2017 | Muckler | |

* cited by examiner

*Primary Examiner* — Eugene L Kim
*Assistant Examiner* — Christopher Glenn
(74) *Attorney, Agent, or Firm* — John L. DeAngelis; Wolter Van Dyke; Davis, Pllc

(57) ABSTRACT

A surface having a controllable contour. A plurality of closely-spaced panels form the surface. A post actuator is disposed beneath each panel vertex such that application of a force to a post actuator causes the post actuator to vertically extend and thereby a region of a panel above the post actuator to move upwardly. Release of a force on a post actuator causes the post actuator to contract vertically and permit a region of the panel above the post actuator to move downwardly. Each post actuator is independently controllable to extend and contract. A control system supplies water to each post actuator to vertically extend the post actuator and releases water from each post actuator to cause the post actuators to contract vertically. By controlling the supply and release of water to and from each post actuator a desired contour for the panels can be achieved.

20 Claims, 11 Drawing Sheets

GOLF PUTTING GREEN WITH CONTROLLABLE SURFACE CONTOUR

CROSS REFERENCE TO RELATED APPLICATIONS

The present application claims priority under 35 U.S.C. 119(e) to the provisional patent application filed on Oct. 6, 2020 and assigned application No. 63/088,117. The provisional patent application is incorporated herein in its entirety.

TECHNICAL FIELD

The present invention relates to a golf putting green and more particularly to a method and apparatus for fabricating and operating a putting green that has a controllable contour surface and is dynamically moveable to allow the green surface to present many different shapes and emulate regions of putting greens of famous golf courses.

BACKGROUND OF THE INVENTION

In general, to practice putting on a specific green at a specific hole on a specific golf course the golfer needs to travel to that golf course and practice on that green. Clearly not a convenient practice regimen. A golfer can measurably increase his/her putting ability and shave putting strokes off the final score by practicing on greens with different contours and different cup locations relative to the shaped contour.

SUMMARY

The present invention allows the golfer to practice on any contoured golf green surface, away from the golf course, for example, at practice greens or even in one's own backyard.

In order to accomplish this, the inventive product must be able to assume the shape of any (or at least most) greens on demand. Thus, the present invention comprises a putting green base that further comprises multiple triangular panels (preferably triangular, but other polygonal shapes will also work) resting on an array of actuator posts. The actuators may be operated (i.e., raised) hydraulically or using a different actuating force, such as an electric motor. Also, in either embodiment the array of triangular panels is covered by a material layer that mimics a real surface, such as the grass on a golf green.

In one embodiment the present invention uses vertical hydraulically-driven post actuators to control the height of each vertex or corner on a surface panel that forms the playing surface. For example, the panel may comprise the three vertices of a triangle. On command, a control system raises or lowers each post to achieve a desired surface contour or to mimic a specific putting green configuration.

The vertical height of each post, as required to achieve a desired contour, is stored in memory. A processor retrieves each post height value and controls a hydraulic system to properly establish each post height. As the posts are vertically displaced (vertically extended to rise in height or vertically contracted to reduce in height), the surface panels disposed atop the posts follow the posts up or down to create a contour surface (also referred to as a floor surface). The user may create a surface that is similar to a known putting green. In addition, since the posts move independently and the system is user-configurable, other putting green shapes that do not represent an actual putting surface, can be created at will.

In addition to providing a contour surface for golf putting greens, this invention can be useful for a variety of other applications, such as a NASA Mars surface simulator, a dynamic movie set, and an adjustable surface for war game simulations and paint-ball games.

BRIEF DESCRIPTION OF THE DRAWINGS

The present invention can be more easily understood and the advantages and uses thereof more readily apparent when the detailed description of the present invention is read in conjunction with the figures wherein.

In accordance with common practice, the various described features are not drawn to scale, but are drawn to emphasize specific features relevant to the invention. Like reference characters denote like elements throughout the figures and text.

DETAILED DESCRIPTION OF THE INVENTION

Figure 1:
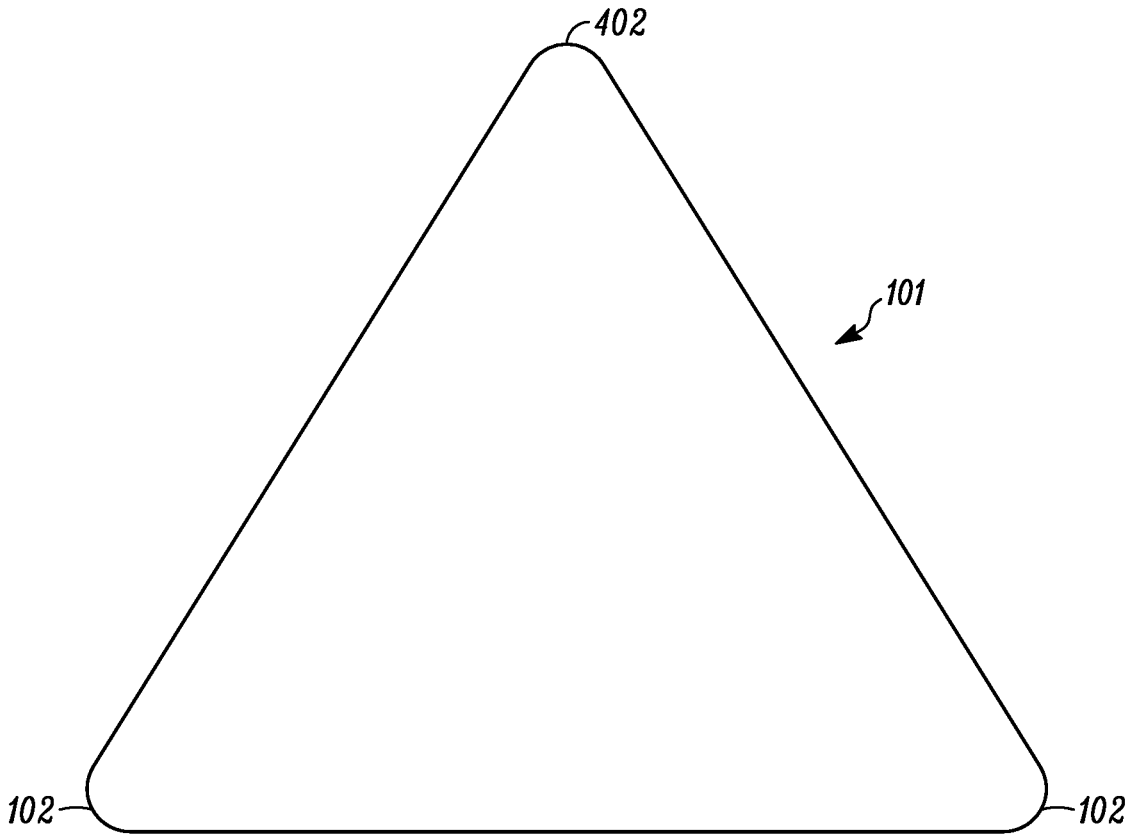
FIG. 1 illustrates a triangular plate top surface that could be used, in one embodiment, to form the moveable floor surface.

There are a number of features that a golf green can include, such as slopes, curves, sand pits, etc., but the most significant features are the slopes and curves that form the surface contours that lie between the golf ball and the cup. Skill at putting on such a surface is most important for a golfer to develop.

Even though one embodiment of the invention provides only grass or simulated grass surface contours, other embodiments include small sand pits, water features, and other common golf course obstacles. As such, this invention is primarily intended to recreate any contour surface within the operating range of the scale of the installation, allowing a golfer to practice on a wide variety of surface contours, without ever leaving home. Of course, many commercial golf courses and golf driving ranges may also want to offer a contour-controlled putting green, especially since it can be implemented indoors or outdoors. For example, a golf course with a configurable putting green surface can allow golfers to individually select green configurations, for example beginner, intermediate, or advanced.

A golf course can also include a rental green, configurable as taught by the present invention, that has been programmed to provide exact replicas of the greens on that course. If a golfer frequently has problems putting on the green on hole 4, for example, he can rent the green, select 'hole number 4', and practice putting on hole 4. As golfers know, during a golf match a golfer cannot stop at a hole and practice putting on the green. This invention provides unlimited putting practice opportunities for any green on the course.

The reference numerals set forth below refer to the elements in the various FIGS. 1-10.

In a preferred embodiment, the invention comprises substantially rigid equilateral triangular floor panels displaced vertically by vertical lift post actuators located below each panel vertex. FIG. 1 shows a top view of an equilateral triangular floor panel 101. Note that vertices 102 are rounded. If an actuator is moved to a height that is lower than the height of the surrounding surface (as determined by other actuators), rigid panels in that area will lean or tilt slightly toward each other. And since the center of rotation of each panel vertex is about one inch below the top surface of the panel, the panel edges in that lowered area will move toward and likely strike and thereby interfere with adjacent panels. This situation is resolved by allowing some clearance between the vertices of each panel. Rounding (to a curved shape) or truncating (removing the point at which the two panel edges converge) the panel vertices provides that clearance. Also, if the panel edges are about 0.060 inches apart when setting flat (for panels that are 12 inches corner-to-corner), the problem of adjacent panel interference should be avoided. Also, preferably the diameter of the spherically shaped cavity in which the ball joint sets (the cavity on the bottom surface of a panel) is larger than the diameter of the ball joint, thereby allowing the ball joint to slide slightly to one side or the other within the cavity as the hub/post is raised or lowered.

Figure 2:
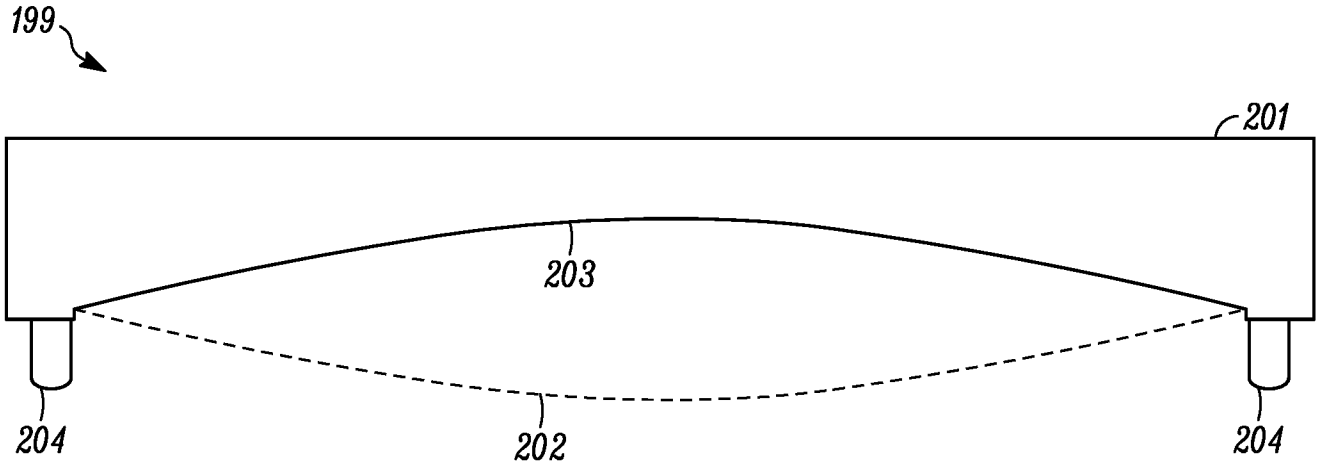
FIG. 2 is a side view of the triangular floor panel showing one embodiment of a contour that provides strength and reduces system costs.
Figure 3:
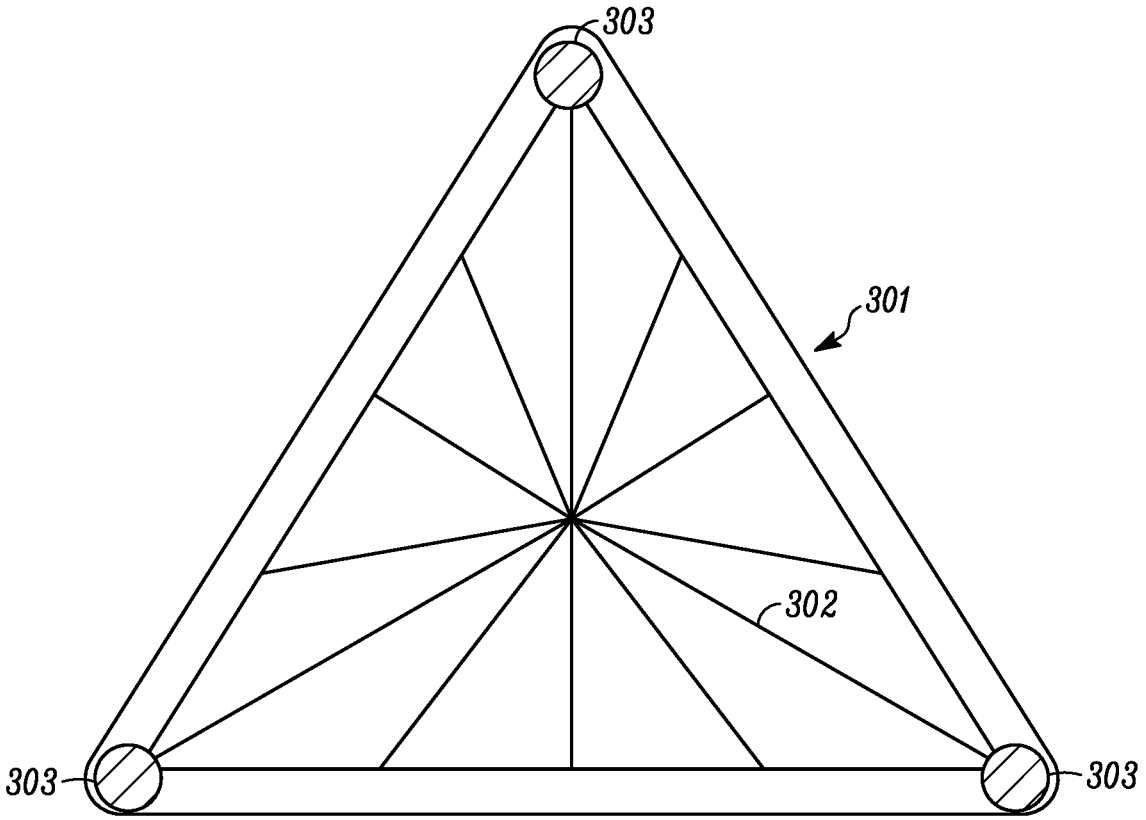
FIG. 3 is a bottom view of the triangular floor panel showing possible underside ribbing and 'knuckle joints' on the corners that allow panel movement to create a desired contoured surface.

FIG. 2 depicts a floor panel 199, comprising a top surface 201 and a bottom surface 203, which represents a dimensionally minimum panel thickness. To minimize the cost and weight of each panel, a bottom surface may also be contoured, such as a contoured bottom surface 202 in FIG. 2. The bottom surface may also comprise bottom ribs 302 (see FIG. 3) that serve as structural I-beams to provide additional panel strength.

Knuckle joints 204 (FIG. 2 side view) and 303 (FIG. 3 bottom view) (also referred to as ball joints) are disposed at each panel vertex. The knuckle joints are received within cavities within the actuator post cap. These cavities have a shape similar to the knuckle joints and are slightly larger than the knuckle joints to allow each knuckle joint, and thus each panel, to slide slightly as it is raised and lowered. As the actuator raises and lowers, these 'knuckle joints' rotate and slide within the cavity and keep the floor panel 301 (FIG. 3) from moving laterally. Note that each vertex of the triangle (vertices 102 of FIG. 1, for example) includes a 'knuckle joint,' and thus in one embodiment each vertex is controlled by a vertically actuated moveable post or by a fixed post.

By using equilateral triangle floor panels, a hexagonal pattern is formed (see FIG. 4) that is at the same time rigid and completely controllable. No other geometric shape has this property. For example, squares can be moved up and down by actuator posts, but if all four corners are not in the same plane (as determined by an actuator post at each corner) the panel will not contact a post at all of its four corners and will rock back and forth when stepped on. This will result in motion similar to a chair with one leg shorter than the others. This problem limits the ability to control the contour surface.

The completed contoured surface may include a top layer (see FIG. 10 as described below) constructed of material representing a putting green surface or another surface as desired by the user.

Figure 4:
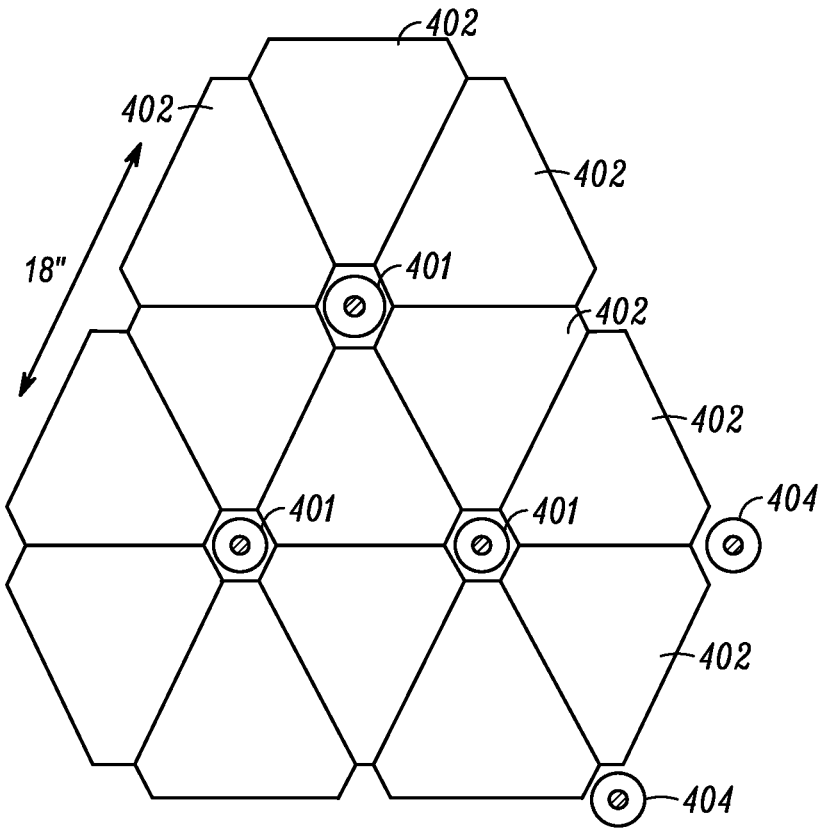
FIG. 4 illustrates a simple floor plate grid layout showing three vertically moveable internal posts (also referred to as vertical actuators or post actuators) for altering the contour of the surface.

A simple configuration of floor panels and posts is shown in FIG. 4. It is clear that each moveable post 401 supports the vertices of six floor panels. Fixed supports 404 around the periphery (only two shown) each support either two or three floor panel corners. Note that fixed posts support three panels along a straight-line edge of a floor panel array. See FIG. 5. Thus, each vertex is supported by either a moveable post or a fixed post.

Special curved and shaped configurations of the putting green can also be created by appropriate adjustment of each actuator and thus each panel as controlled by actuators. For example, a kidney-shaped putting green surface, requiring the golfer to put "around a corner" can be created according to the present invention.

Returning to FIG. 4, six floor panels 402 form a hexagonal shape and one vertex from each of six adjacent floor panels rests on one of the moveable post actuators 401. Note that certain triangle vertices have been omitted from this figure (a cutaway view) to reveal the post actuators 401. It can also be seen from this view that the entire structure is scalable such that individual floor panels can be any convenient size if all three sides of the panel are the same length. This allows for larger panels (in one embodiment 16" on a side) and fewer post actuators for the same area. The downside to this configuration is that the floor panel triangular shape is the smallest unit of adjustment for the surface contour, and larger panels limit the amount of surface contour that can be achieved. Larger panels tend to have larger 'flat' spots, but are cheaper to build.

The use of smaller panels (for example, 9" on a side) allows more detailed contoured shapes to be configured with smaller and fewer 'flat' spots, but requires more post actuators to operate the controllable floor and more floor panels to cover a given area. These factors increase cost. This issue is similar to the resolution of digitized data. As the smallest increment within the data gets smaller the number of data elements increases, but so does the accuracy of the data.

In one embodiment, the distance between posts in FIG. 4 is 18 inches (as indicated), resulting in an area of about 14.63 square feet for the FIG. 4 array. In the middle of the array, the area covered by a post is about 1.69 square feet. This is the equivalent area that a single post supports, which is a third of the area of the six panels that each actuator supports. This defines the actuator worst case loading.

Figure 5:
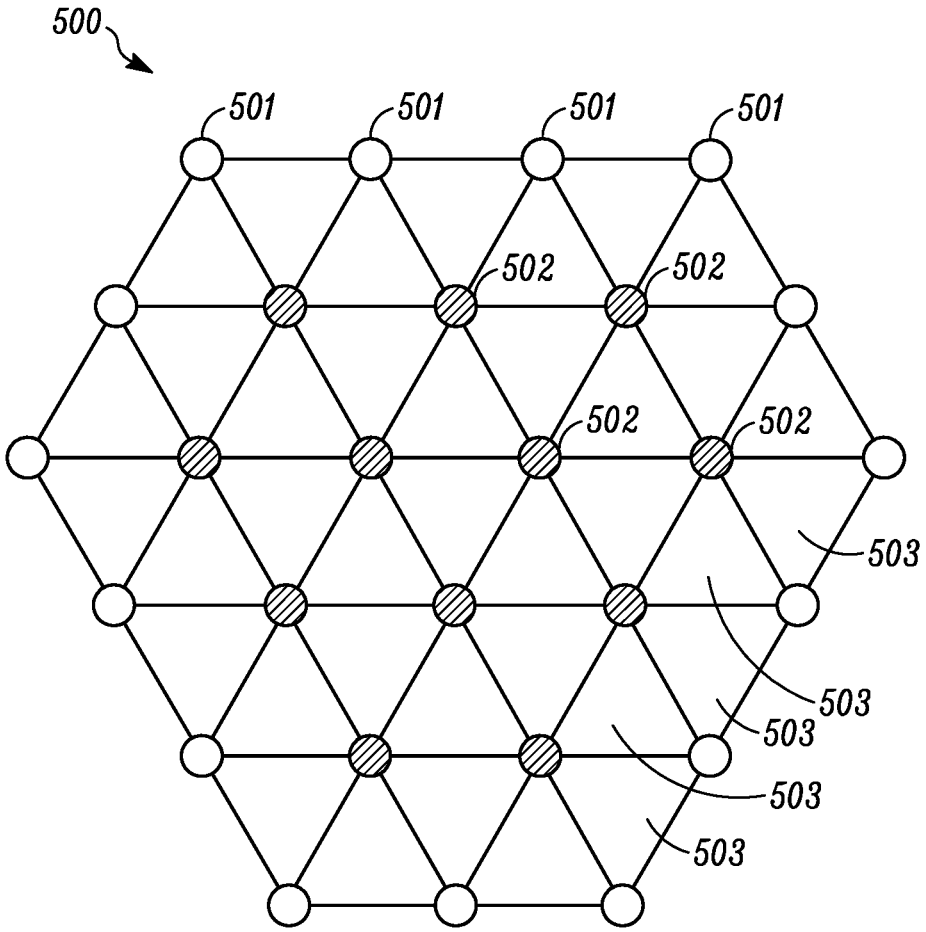
FIG. 5 illustrates a larger grid array of floor panels.

FIG. 5 shows a large array 500 with more moveable post actuators 502, more floor panels 503, and many more fixed edge supports (fixed posts) 501, than in the FIG. 4 embodiment. FIG. 5 shows thirty-seven panels 503, twelve moveable posts 502, and 15 fixed posts 501. This illustration allows one to better visualize that many actuators allow for many combinations of heights and many different floor shape contours.

It is important to note that equilateral triangles are not the only panel shape for the configurable floor of the present invention. Other shapes, such as hexagonal panels, can be used, but these allow less contouring of the surface shape and may introduce other issues, such as the stability of a panel. Also, the panel shape can have a length greater than its width or vice versa. Non-flat panels can also be utilized.

In lieu of the described panel embodiment, it is also possible to form the contoured floor with a stiff, but partially flexible and springy solid sheet material affixed to all post actuators. Reduction or elimination of 'flat' spots in the floor surface is one benefit of this embodiment. However, there are a number of drawbacks to this technique, including identifying a material that is sufficiently flexible to be moved by a post, yet stiff enough to feel like a solid surface when walked on. Also, disadvantageously, the described actuator-based system cannot pull the surface down, as described below. The present invention therefore relies on the weight of the surface to push the actuator down after the internal pressure exerted by the water has been released. The triangle floor panels are individually completely rigid and do not exhibit the problem of flat spots. Advantageously, the panels fall under their own weight.

Figure 6:
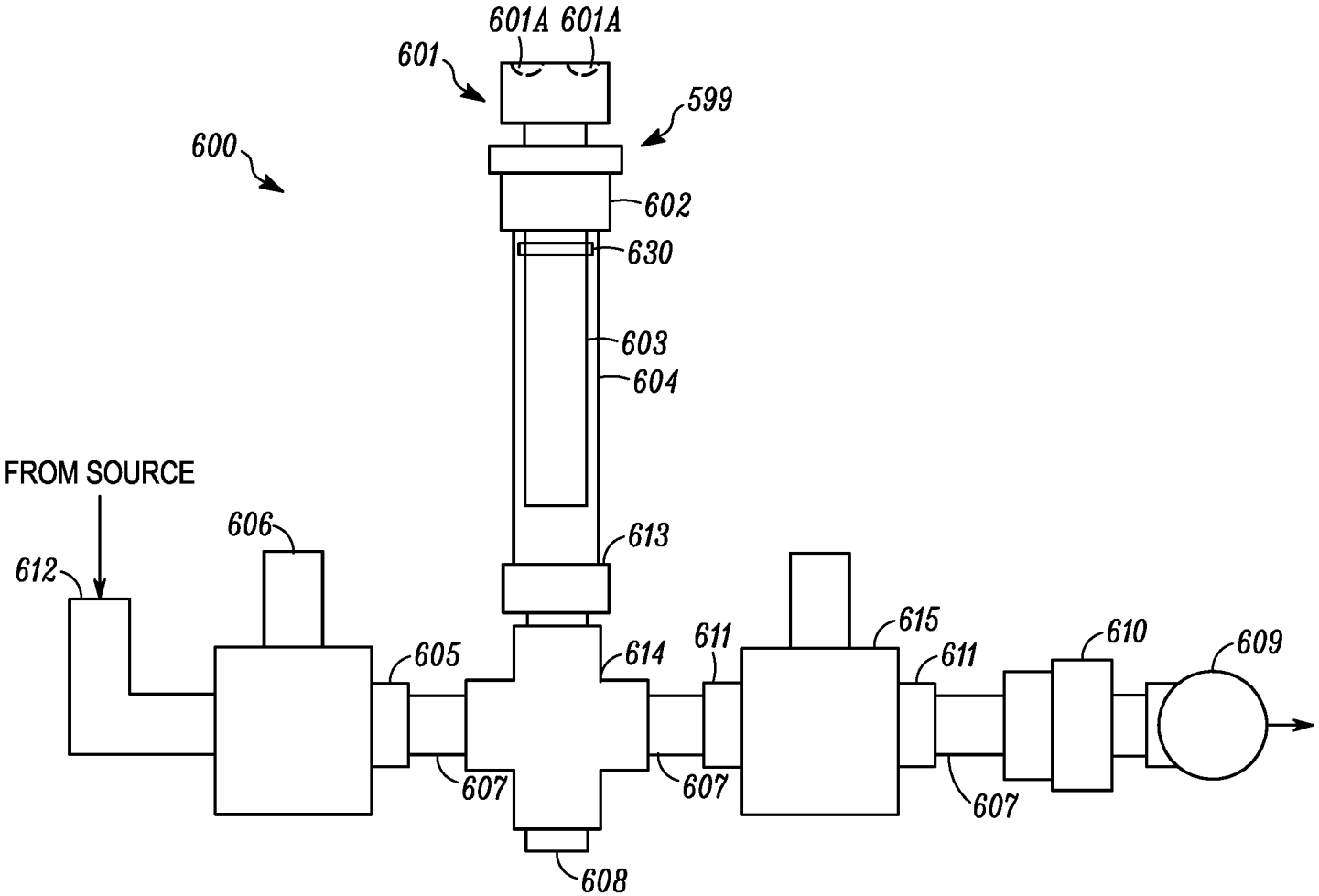
FIG. 6 illustrates an individual hydraulic post actuator and control mechanism.

The other major component of the inventive system is a control system 600 (see FIG. 6) for controlling the post actuators. FIG. 6 shows one embodiment of a control system with each actuator 599 comprising two sizes (i.e., diameter and length) of PVC pipe configured concentrically with an O-ring seal 630 between an outer surface of an inner pipe 603 and an inner surface of an outer pipe 604.

As described above, the water-based hydraulic actuation system controls vertical motion of the actuators that in turn controls the height of each panel. Using water eliminates risks associated with chemicals leaking into the ground or surface on which the contoured surface sets, and allows water pressure available from a typical house or building to power the actuators.

This illustrated system configuration uses a 1.25" diameter inner pipe 603 inside a 1.5" diameter outer pipe 604, along with a number of fittings and elements, including: a cap 601 with semispherical depressions 601A (only two shown) each one for receiving a knuckle coupler disposed along a bottom surface of each panel, reducer couplings 602 and 613, a cross coupler 614, a cap 608, male adapters 605 and 611, and connecting pipes 607. These are the primary elements that form the vertical post actuator 599. The pipes 603 and 604 may be fabricated from PVC material.

To raise a panel, water is made to flow in from a source through an elbow 612. When a valve 606 is opened the water flows through the cross coupler 614 into the actuator 599, causing the inner pipe 603 to rise relative to the outer pipe 604.

A circular groove (not shown) is formed on the inner surface of the outer pipe 604 for receiving the O-ring seal 630. Preferably, the groove is formed near an upper end of the outer pipe 604. Depending on the outside diameter of the inner pipe, it may be necessary to turn down that diameter to a smaller value, using a lathe for example. This will reduce the outer diameter of the inner pipe to the correct size to sufficiently compress the O-ring seal 630 and thereby create a tight seal against the water pressure as the inner pipe rises and passes through the O-ring seal.

To lower the actuator, the valve 606 is closed and a valve 615 is opened, allowing the pressure in the actuator created by the overlying panel or floor weight to exert a downward force on the inner pipe 603. The downward motion of the inner pipe pushes water out from the actuator through the open valve 615, a union 610, and a discharge pipe 609.

A tee 609 connects the illustrated pipe elements to other actuators and associated piping for controlling other actuators in the array of panels.

When both valves 606 and 615 are closed the actuator is frozen in place and cannot move. This is the system state after the putting surface reaches its desired contour and is therefore ready for the golfer to stand on and practice putting.

Note that there are many variations in piping and valving configurations that can be implemented to perform the task of driving water into each actuator to raise it and removing water from the actuator to lower it. For example, another embodiment uses a positive displacement pump, such as a peristaltic pump, to drive a fixed amount of water into the actuator and then later to remove the same amount of water from the actuator. A value representing the fixed amount of water is stored in a computer memory that operates in conjunction with a processor to control the peristaltic pump.

The valve arrangement illustrated in FIG. 6 can also be adjusted to require only a single valve for each actuator, with a pair of valves connecting the feed supply and drain to a main distribution piping system.

Figure 7B:
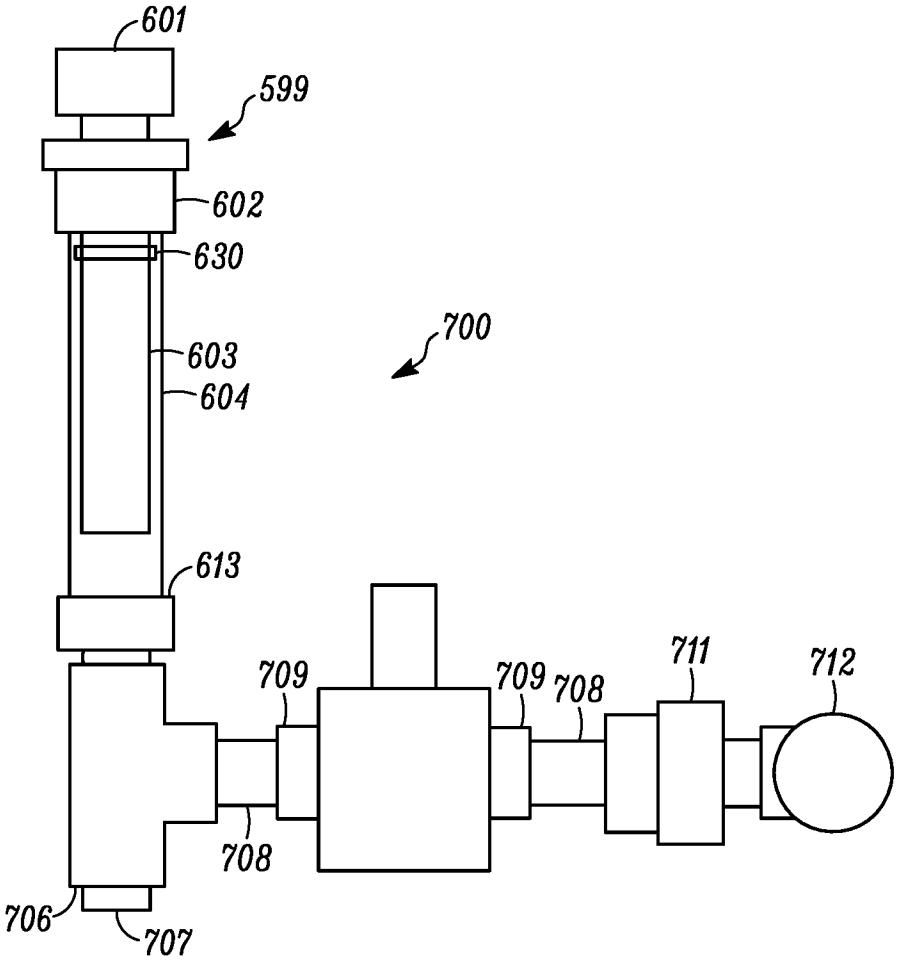
FIGS. 7A and 7B illustrate components of a fluid flow path for hydraulically control post actuator height.
Figure 7A:
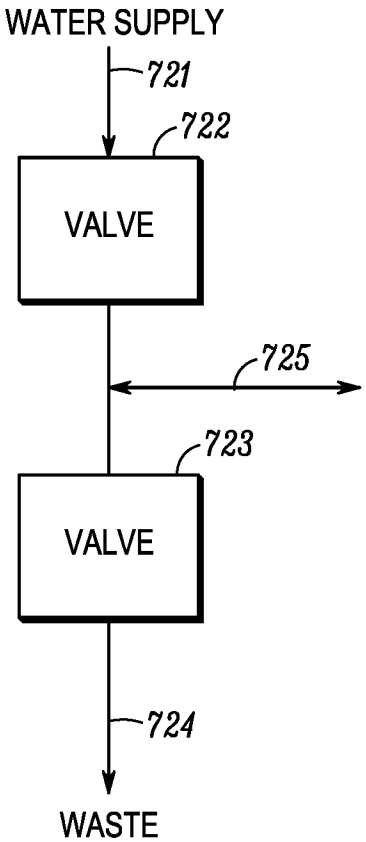

One such alternative control system 700, with reduced parts count, is shown in FIGS. 7A and 7B. In the system 700 the water feed network and the water discharge network are combined. FIG. 7A depicts the main system components that control the flow of water to and discharge water from each of the individual actuators 599 of FIG. 7B (only one actuator illustrated in FIG. 7A). In FIG. 7A an input valve 722 controls the flow of water from a supply line 721. Outflow from the valve 722 is distributed to all actuators via piping 725. A discharge valve 723 is also connected to the piping 725 to control the flow of discharge water from the post actuators into a waste or discharge line 724.

In operation, the system opens the input valve 722 and sequentially opens each individual actuator valve 710 (See FIG. 7B.) to raise each actuator post. After all posts have reached their final position, the valve 722 remains open to hold pressure on all actuator posts. To simultaneously lower all the posts, the input valve is closed (or controlled to an OFF condition) and the discharge valve 723 is opened (or controlled to an ON condition) to allow the individual actuator posts to bleed water back through their individual valves 710, through the discharge valve 723 to the waste or discharge line 724.

With reference to FIG. 7B, certain components are similar to those illustrated in FIG. 6 and thus are referred to by the same reference numeral. In the system 700 the post actuator comprises essentially the same elements as in FIG. 6, except each actuator comprises a tee 712 for connecting (through intervening piping) at one end to the feed water valve 722 (See FIG. 7A) and on the other end to the discharge valve 723 (See FIG. 7A) A union 711 connects the valve 710 to the tee 712. A tee 706 interfaces the coupler 613 and the valve 710 through a pipe 708. An open end of the tee 706 is closed with a plug 707. The tee 706 can be replaced by a 90-degree-bend elbow. The valve 710 connects to a union 711 also via the pipe 708, which in turn is connected to the tee 712.

Control of the system 700 is best accomplished by first discharging all water from all post actuators by closing the feed water valve 722, opening the discharge valve 723, and opening all actuator valves 710. Once all the water has been drained, all actuator valves 710 are closed, except one actuator valve is opened. This actuator post is raised to its desired height by supplying water from the water supply of FIG. 7A to its open valve 710 into the actuator post 599.

Then, the other actuator posts are successively raised to each one's desired position, by supplying water through its valve 710.

For larger systems, since raising an actuator post essentially shortens its distance to the next hub and may therefore cause excessive deflection of the panel, the control system may limit the extension range of a post until proximate posts are also raised. This limit may be 1" or 2" on a per panel basis. For example, with a ten-panel array, the center can be raised by about ten inches. This limit is related to certain dimensional limitations that restrict the amount each panel can move relative to the next hub, due to the initial size of the gap between panels and the size the knuckle ball cavity (depression 601A of FIG. 6) relative to the actual ball joint (knuckle coupler).

It should be noted that no mention has been made of a feedback path that senses post height and supplies this information back to a system controller. Those skilled in the art are aware of many different feedback techniques to determine post height and supply this information to the system controller. Thus, it is considered beyond the scope of this disclosure to address such feedback techniques. Instead, it will be noted that in another embodiment a feedback sensor is required for each actuator and this feedback information is used to determine when the desired surface contour has been achieved.

Figure 8:
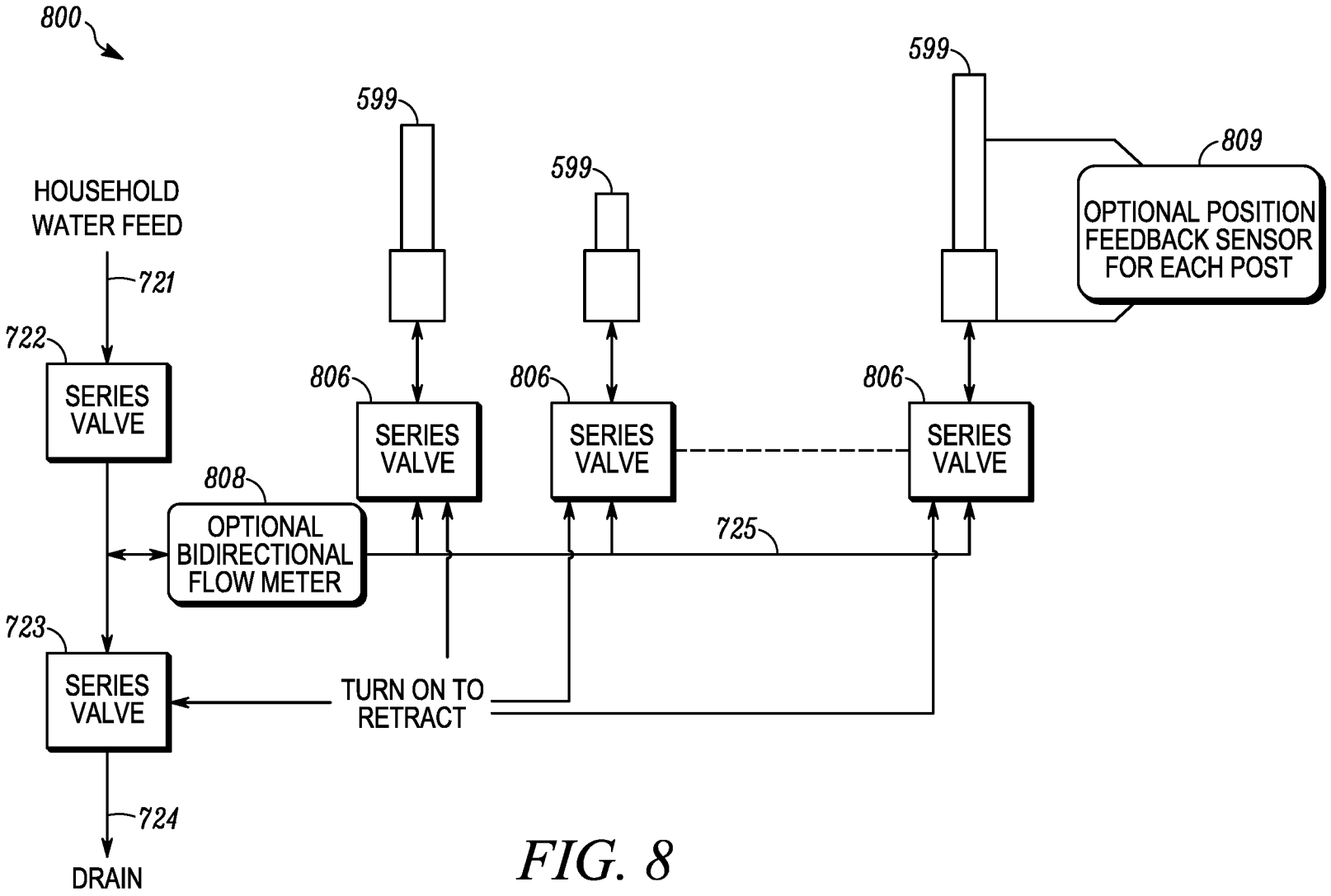
FIG. 8 illustrates another embodiment of a hydraulic plumbing interconnect system with multiple post actuators.

One technique for determining actuator height, although not an individual feedback mechanism for each actuator, is shown in a full distribution system 800 FIG. 8, which includes a bidirectional flow meter 808 and N actuators 599. This technique requires that only one actuator 599 be raised and while the actuator is rising, the flow meter 808 or an equivalent flow control mechanism, such as a peristaltic pump, measures the amount of water that flows into the rising actuator. This information can then be used to calculate the height of that actuator, since all the actuator dimensions are known and are in fact the same for each actuator.

When a first actuator reaches the desired height, its valve 710 (FIG. 7B) or another series valve 806 (FIG. 8) is closed and the valve 710 or 806 on a second actuator 599 is opened. This water flow measurement technique is repeated to determine the distance each actuator was raised. This step and repeat process continues until all actuators are at the correct height (to achieve the desired contour), with the water flow volume for each actuator measured as the actuator rises to its correct height. All valves are placed in an OFF or closed condition for static operation of the contour surface.

For larger systems this may offer an unacceptably slow response times since only one actuator flow is measured by a single flow meter or pump. Thus, multiple flow meters or pumps may be employed, as optimized for a combination of cost and performance.

With any pumping system that uses flexible tubing piping, an upward travel distance of a post actuator is always slightly greater than the down travel distance, since the flexible tubing shrinks slightly with a lower internal pressure during down travel of the post. This may result in a measurable error after many up/down cycles unless corrected. One solution uses a pressure sensor on the tubing that will rapidly go negative once the actuator finally hits bottom and no more water can flow out from it.

A position feedback sensor 809 for supplying actuator height information is also shown in FIG. 8. The feedback sensor 809 is used in lieu of the techniques described with respect to FIGS. 7 and 8 for determining actuator height information.

Figure 9A:
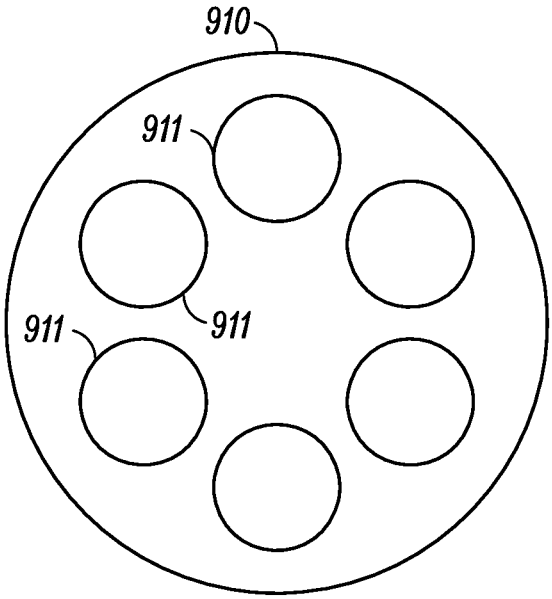
FIGS. 9A and 9B are a top view and side view of a cap that sets atop each post actuator with six locations for mating with six triangular floor panels.
Figure 9B:
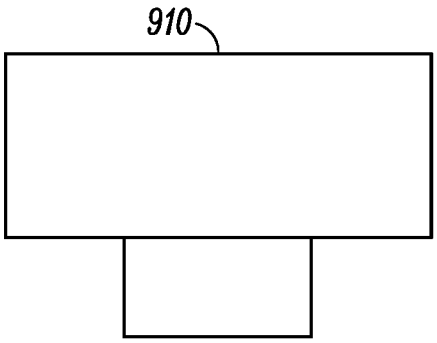

FIGS. 9A and 9B show one embodiment of a top head 910 (also referred to as a cap) that sets atop each post actuator. The FIG. 9A embodiment is intended for use with the triangular floor panels of FIG. 4 and thus six semispherical depressions 911 are formed therein. Each depression 911 receives a knuckle joint that extends downwardly from a bottom surface of each one of six panels. This technique allows each floor panel to form a different angle with the other floor panels without creating material stresses in the panels. In addition, as mentioned elsewhere herein, raising one vertex of a triangular floor panel higher than adjacent vertices results in an effective shortening of the horizontal distance between the panels. The ball of each knuckle joint must be slightly smaller in diameter than the depression (socket) into which it fits, so that the knuckle joint can shift slightly within the depression.

With reference to FIG. 4, note that details of the top head 910 (atop each post actuator) nor the knuckle joints on the lower surface of each floor panel are shown.

Figure 10:
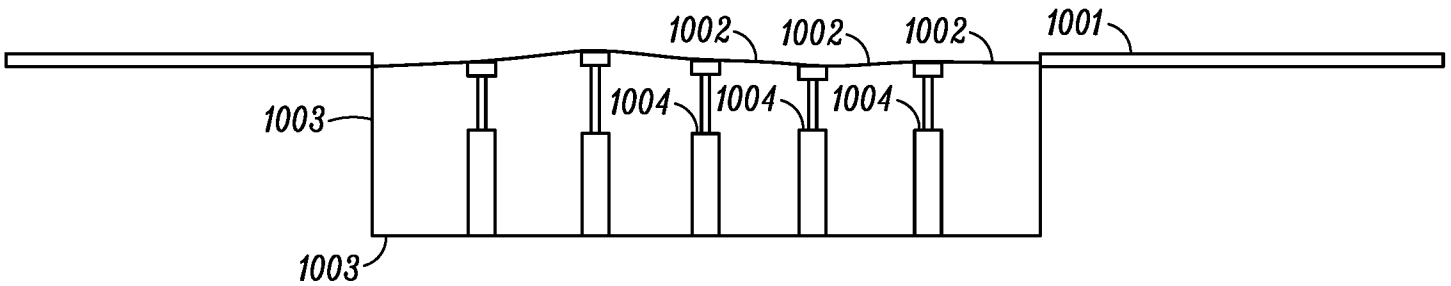
FIG. 10 is a side view of an installation showing the floor panels at approximately the ground level with all controls and post actuators located underground.

FIG. 10 shows a side cutaway view of a typical underground installation 1000 formed within an opening in a ground surface 1001. Poured concrete or a similar rigid material serves as a bottom base and side surfaces 1003 to support actuators 1004. A gravel base under the concrete floor and a drain allow for rain and leaked water to exit the underground cavity so that all the components inside stay dry. Floor plates or panels 1002 ride on top of the actuators. In lieu of the individual panels, a sheet surface is attached to the actuators. This configuration allows the putting green to be level with the surrounding landscape at edges 1003 of the putting green.

Use of the top material layer (of rubber or a similar mat-type material) covering the panels 1002 is preferred to prevent water, soil and other debris from falling into the actuators and ball joints. The top material layer, which forms the playing surface for the user, must flex with the rising and falling of the actuator posts and the panels attached thereto. According to one embodiment, the top material layer is about one inch thick, but must be sufficiently flexible to follow the shape of the underlying contoured surface. Applications aside from a putting green may use a top material layer that is different from the top material layer used to represent a putting green.

Figure 11:
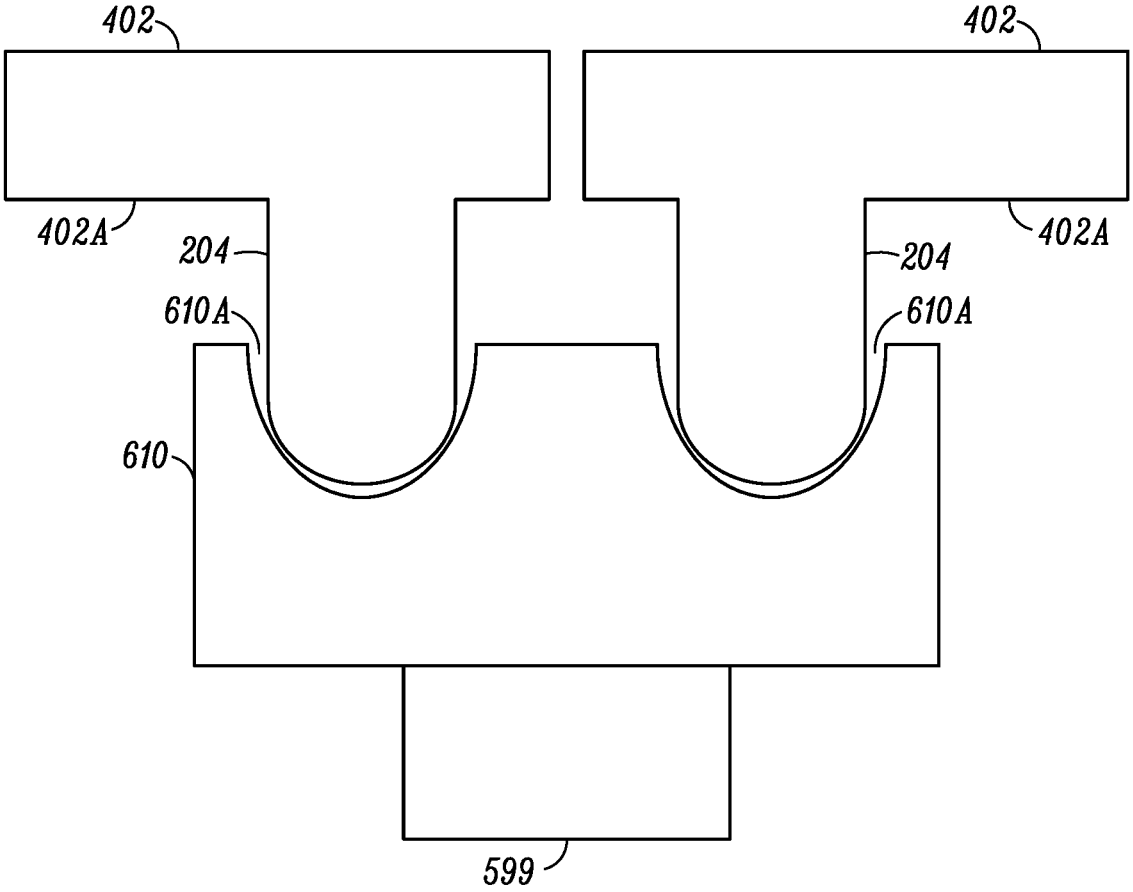
FIG. 11 illustrates a side view of two knuckle joints within a cap.

FIG. 11 illustrates the cap 601 (from FIG. 6) (or the cap 910 from FIGS. 9A and 9B) including the depressions 601A. Two adjacent panels 402 each have one knuckle joint 204 extending downwardly from a bottom surface 402A and received within one of the depressions 601A. The cap 601 sets atop the actuator post 599. As can be seen, the depressions 601A are larger than an end region of the knuckle joints 204, thereby allowing the knuckle joints to move within the depressions as the panel moves up and down.

What is claimed is:

1. A surface having a controllable contour, comprising:

a plurality of closely-spaced panels;

a plurality of spaced apart post actuators disposed beneath each panel such that application of a force on a first post actuator causes the first post actuator to extend vertically and cause a region of a panel above the first post actuator to move upwardly, and release of a force on a second post actuator causes the second post actuator to contract vertically and permit a region of the panel above the second post actuator to move downwardly, wherein each post actuator is independently extendable and contractible;

a conduit system for supplying a non-compressible fluid to a first group of the plurality of post actuators to cause the first group of post actuators to extend vertically and for releasing the non-compressible fluid from a second group of the plurality of post actuators to cause the second group of post actuators to contract vertically, thereby achieving a desired contour for the plurality of panels;

wherein each panel comprises a triangular shaped panel, and wherein a post actuator is located at each vertex of the triangular shaped panel; and wherein the six triangular shaped panels are arranged to form a hexagon and one vertex from each of the six triangular shaped panels is disposed atop one post actuator.

2. The surface of claim 1, further comprising a material surface layer disposed above and in contact with the plurality of panels.

3. The surface of claim 1, wherein the material surface layer mimics a golf green surface.

4. The surface of claim 1, wherein each vertex of the triangular shaped panel is truncated.

5. The surface of claim 1, wherein each vertex of the triangular shaped panel exhibits a curved shape.

6. The surface of claim 1, the six triangular shaped panels disposed with a gap between adjacent edges of two adjacent panels.

7. The surface of claim 1, wherein a shape of each panel is a polygon.

8. The surface of claim 1, wherein each post actuator comprises an inner tubular member nested within an outer tubular member, and a seal disposed between an outer surface of the inner tubular member and an inner surface of the outer tubular member, such that as the non-compressible fluid is supplied to a post actuator, the inner tubular member is displaced upwardly within the outer tubular member causing the post actuator to extend vertically.

9. The surface of claim 1, further comprising a valve associated with one of the plurality of post actuators for controlling supply of the fluid to the one post actuator and the release of the fluid from the one post actuator, and further comprising a control system for controlling the valve to an open state to supply the fluid to and thereby vertically extend the one post actuator, for controlling the valve to a closed state to retain the one post actuator in a current configuration, and to an open state to drain the fluid from and thereby permit the one post actuator to vertically contract.

10. The surface of claim 1, further comprising a control system for controlling a fluid supply to certain ones of the plurality of post actuators and for releasing the fluid from certain other ones of the plurality of post actuators to thereby control the contour of the surface.

11. The surface of claim 1, wherein the contour of the surface represents the contour of a golf course green.

12. The surface of claim 1, further comprising a valve associated with each one of the plurality of post actuators for controlling supply of the fluid to each post actuator and release of the fluid from each post actuator, and further comprising a control system for controlling the valve associated with each one of the plurality of post actuators to thereby supply fluid or release fluid from each one of the plurality of post actuators such that the surface is configured with a desired contour.

13. A surface having a controllable contour, comprising:

a plurality of closely-spaced panels;

a plurality of spaced apart post actuators disposed beneath each panel such that application of a force on a first post actuator causes the first post actuator to extend vertically and cause a region of a panel above the first post actuator to move upwardly, and release of a force on a second post actuator causes the second post actuator to contract vertically and permit a region of the panel above the second post actuator to contractible;

a conduit system for supplying a non-compressible fluid to a first group of the plurality of post actuators to cause the first group of post actuators to extend vertically and for releasing the non-compressible fluid from a second group of the plurality of post actuators to cause the second group of post actuators to contract vertically, thereby achieving a desired contour for the plurality of panels; and further comprising a knuckle joint extending downwardly from a bottom surface of a panel at each panel vertex, and wherein the knuckle joint is received within a depression within a top surface of a post actuator.

14. The surface of claim 13, wherein a post actuator comprises a cap and the depression is formed within the cap.

15. A surface having a controllable contour, comprising:

a plurality of closely-spaced panels;

a plurality of spaced apart post actuators disposed beneath each panel such that application of a force on a first post actuator causes the first post actuator to extend vertically and cause a region of a panel above the first post actuator to move upwardly, and release of a force on a second post actuator causes the second post actuator to contract vertically and permit a region of the panel above the second post actuator to move downwardly, wherein each post actuator is independently extendable and contractible;

a conduit system for supplying a non-compressible fluid to a first group of the plurality of post actuators to cause the fist group of post actuators to extend vertically and for releasing the non-compressible fluid from a second group of the plurality of post actuators to cause the second group of post actuators to contract vertically, thereby achieving a desired contour for the plurality of panels; and wherein each panel comprises a triangular panel with six triangular panels configured to form a hexagon, and wherein an upper surface of each post actuator defines six depressions arranged in a circle, each triangular panel further comprising a knuckle joint extending downwardly from a bottom surface of each triangular panel, each knuckle joint disposed within one of the six depressions.

16. The surface of claim 15, wherein each depression is larger than the knuckle joint received within the depression to permit the knuckle joint to move within the depression as the panel is raised or lowered.

17. The surface of claim 15, wherein the non-compressible fluid comprises water.

18. The surface of claim 15, further comprising fixed post actuators that are neither extendable nor contractible, the fixed post actuators disposed along a periphery of the plurality of panels.

19. The surface of claim 15, wherein the surface comprises a practice putting green and further comprises a hole defined within the surface for receiving a golf ball during putting by a golfer.

20. A surface having a controllable contour, comprising:

a plurality of closely-spaced triangular panels forming a panel array further comprising a plurality of hexagons formed within the array, each hexagon formed by six triangular panels;

a material surface layer mimicking a golf course green disposed above and in contact with the plurality of panels;

a supply of non-compressible fluid;

a plurality of spaced apart post actuators disposed beneath each panel, a top surface of each post actuator defining a plurality of depressions therein, wherein each post actuator comprises an inner tubular member nested within an outer tubular member, and a seal disposed between an outer surface of the inner tubular member and an inner surface of the outer tubular member, such that as the non-compressible fluid is supplied to a post actuator, the inner tubular member is displaced upwardly within the outer tubular member causing the post actuator to vertically extend;

a knuckle joint extending downwardly from a bottom surface of each triangular panel at each panel vertex, each knuckle joint received within a depression, such that one vertex from each of the six triangular panels is disposed atop and coupled to one post actuator;

a conduit system for supplying a non-compressible fluid to each post actuator to vertically extend each post actuator or for releasing the non-compressible fluid from each post actuator to allow vertically contraction of each post actuator, by vertically extending a post actuator a vertex coupled to the post actuator rises, and by allowing vertical contraction of a post actuator a vertex coupled to the post actuator vertically descends; and a control system for operating valves that control a fluid supply to certain ones of the plurality of post actuators and for releasing the fluid from certain other ones of the plurality of post actuators to thereby control the contour of the surface.

* * * * *